US005499673A

United States Patent [19]

Shiga et al.

[11] Patent Number: 5,499,673

[45] Date of Patent: Mar. 19, 1996

[54] METHOD OF AND APPARATUS FOR CONVEYING AND GUIDING THIN METAL STRIP FORMED BY QUENCHING

[75] Inventors: Nobuo Shiga; Tomohiro Marui; Kiyoshi Shibuya; Toru Sato, all of Chiba; Michiharu Ozawa, Tokyo; Masao Yukumoto, Chiba, all of Japan

[73] Assignee: Kawasaki Steel Corporation, Japan

[21] Appl. No.: 322,955

[22] Filed: Oct. 13, 1994

Related U.S. Application Data

[63] Continuation of Ser. No. 72,778, Jun. 7, 1993, abandoned.

[30] Foreign Application Priority Data

Jun. 8, 1992 [JP] Japan ..... 4-147486

[51] Int. Cl.[6] ..... B22D 11/06

[52] U.S. Cl. ..... 164/463; 164/423; 226/97

[58] Field of Search ..... 164/423, 463, 164/477, 417; 226/97; 242/78.8

[56] References Cited

U.S. PATENT DOCUMENTS

| | | | |
|---|---|---|---|
| 3,587,177 | 6/1971 | Overly | 34/156 |
| 3,705,676 | 12/1972 | Overly | 226/97 |
| 4,448,236 | 5/1984 | Kimura | 164/463 |
| 4,450,997 | 5/1984 | Li | 226/97 |
| 5,014,447 | 5/1991 | Hagen | 226/97 |
| 5,207,777 | 5/1993 | Shibuya et al. | 164/463 |

FOREIGN PATENT DOCUMENTS

| | | | |
|---|---|---|---|
| 57-112951 | 7/1982 | Japan | 164/463 |
| 60-15424 | 4/1985 | Japan | 164/423 |

*Primary Examiner*—Kuang Y. Lin
*Attorney, Agent, or Firm*—Austin R. Miller

[57] ABSTRACT

A continuous thin metal strip formed by quenching on a single quenching roll is separated from the quenching roll and conveyed along a fly path to a coiling system directly or via pinch rolls. The path along which the thin metal strip flies is stabilized by a jet of a fluid jetted from a slit and biased to flow along a convex curved surface, whereby the time until the strip is taken up or nipped by the pinch rolls is shortened.

15 Claims, 6 Drawing Sheets

METHOD OF AND APPARATUS FOR CONVEYING AND GUIDING THIN METAL STRIP FORMED BY QUENCHING

This application is a continuation of application Ser. No. 08/072,778, filed Jun. 7, 1993, now abandoned.

RELATED APPLICATIONS

The Applicants' assignee, Kawasaki Steel Corporation, is the owner of U.S. application Ser. No. 193,444 filed Feb. 8, 1994, now U.S. Pat. No. 5,456,308 and application Ser. No. 121,184 filed Sep. 14, 1993, now U.S. Pat. No. 5,392,837.

BACKGROUND OF THE INVENTION

1. Field of the Invention

The present invention relates to a method of and apparatus for conveying and guiding a thin metal strip formed from molten metal by quenching using a single roll method and more particularly, to a method and apparatus for smoothly running and guiding the thin metal strip to, for example, a coiling system.

2. Description of the Related Art

A method has been known in which a thin metal strip is formed directly from a molten metal, by bringing the molten metal into contact with the peripheral surface of a cooling roll rotating at high speed so as to cause the metal to be quenched and solidified. This type of method is broadly classified between the "single roll method" and "twin toll method".

The single roll method is suitable for the production of a thin metal strip having a large width. In the single roll method, the molten metal is injected from a nozzle onto a roll rotating at high speed. Consequently, the molten metal forms a deposit which is spread to form a thin layer and is quenched and solidified to form an amorphous metal after the roll surface moves a predetermined distance, i.e., after a predetermined angle of rotation of the roll. The amorphous metal is progressively separated from the roll surface by the centrifugal force generated as a result of rotation of the roll, so as to form a thin The single roll method, however, generally adopts a high forming speed of 20 m/sec or higher. In addition, the thickness of the thin metal strip formed by this method 50 mm or less. The strip, just having been formed, is running free in what is called a "fly path." Therefore, has been difficult to smoothly run and guide the quenched flying thin metal strip to a subsequent device such as a pinch roll or a coiling system.

Among various proposed methods and arrangements for running and taking up thin metal strip separated from the quenching rolls, the most practical method is to nip, by means of pinch rolls, the thin metal strip separated from the quenching roll and flying suspended in the air along a curved path and to guide the strip to the coiling system. Such a method or arrangement is employed, for example, as a means for tensioning a quenched thin metal strip for a rotary coiling device disclosed in U.S. Pat. No. 4,239,187, and in coiling equipment for taking up quenched thin metal strip, as disclosed in Japanese Patent Laid-Open No. 1-143720.

This type of method, however, suffers in that nipping the flying thin metal strip in a curved path is difficult and time-consuming, and wastes the thin metal strip produced until the flying strip is successfully nipped.

SUMMARY OF THE INVENTION

Accordingly, an object of the present invention is to provide a method, as well as an apparatus, which can stabilize the fly path of the thin metal strip separated from the quenching roll and which can smoothly guide the flying thin metal strip to pinch rolls, thereby overcoming the problems of the prior art.

To this end, according to one aspect of the present invention, there is provided a method of conveying a thin metal strip formed from a molten metal by quenching the molten metal on a single quenching roll, wherein the curved path along which the thin metal strip separated from the quenching roll flies is stabilized by a curved jet, as exemplified by a so-called Coanda jet, which utilizes a fluid jetted from a slit and caused to flow along a curved convex surface due to the principles of the Coanda effect.

According to another aspect of the present invention, there is provided an apparatus for conveying a thin metal strip formed from a molten metal by quenching on a single quenching roll to the nip between pinch rolls or to a coiling system, comprising: a curved jet generating device having a slit through which a fluid is jetted and a convex curved surface downstream of the slit, such that the jet is formed along the convex curved surface and serves to stabilize the path along which the thin metal strip separated from the quenching roll is caused to fly.

The Coanda effect utilized in the practice of the present invention is an effect in which, when a fluid jetted from a nozzle is guided by a convexly curved wall, the fluid jet tends to flow in a curve along the convex wall over a considerable portion thereof. This is described in, for example, JSME Mechanical Engineer's Handbook, A. Fundamentals, A5: Fluid Mechanics, pp 66.

Conveyance of thin strip using a Coanda jet has been used for the purpose of conveying paper sheets in facsimile machines. The velocity of paper feed in facsimile machines is generally very low. In contrast, in the production of thin metal strip by quenching, to which the present invention pertains, the quenched thin metal film runs at an extremely high velocity. For this reason, the metal strip quenching art has never imagined that any advantage might be obtained by employing a Coanda jet in the conveyance of the thin metal strip.

It is accordingly an object of this invention to provide a means for stabilizing the fly path of quenched metal strip running at high speed.

Another object is to cause a quenched metal strip to bend around a curved path while stabilizing the curved path.

The above and other objects, features and advantages of the present invention will become clear from the following description when the same is read in conjunction with the accompanying drawings.

The mechanism of generation of the fluid jet flowing along the convex wall due to the Coanda effect (this jet will be referred to as a "Coanda jet", hereinafter) will be explained further in connection with the drawings.

According to the invention, a thin metal strip separated from the quenching roll is conveyed quickly with the guidance and assistance of a Coanda jet to subsequent pinch rolls or to a coiling system as it flies from the periphery of the quenching roll.

It has been discovered that a Coanda jet is able to effectively stabilize conveyance of thin metal strip in a highly advantageous manner, and that it can provide a stable fly path of the thin metal strip so as to stably and quickly convey the thin metal strip to a nip or to another location.

According to the invention, an additional complementary jet may be applied against the surface of the flying thin metal strip opposite to the surface contacted by the Coanda jet. Such additional jet serves to further stabilize the fly path of the thin metal strip on its way to the nip.

Further stabilization of the fly path of the thin metal strip can also be attained by applying, by means of a vacuum suction type conveyor, a vacuum to the surface of the flying thin metal strip opposite to the surface contacting the Coanda jet.

The fly path of the thin metal strip can be still further stabilized when a Coanda jet generating device is connected in series to the vacuum suction type conveyor.

The vacuum suction type conveyor is preferably of a type in which an endless air permeable conveyor belt is provided with a vacuum suction box disposed inside the loop of the belt. The vacuum sucks air across the belt, thereby establishing further stabilization of the fly path.

According to the invention, separation of the thin metal strip from the quenching roll may be triggered by a separation knife which may be of a mechanical or pneumatic one, or by attraction by a magnetic roll, sucking by a vacuum roll or sucking of the thin metal strip by a vacuum suction type conveyor.

It is effective in achieving stabilization of the fly path of the thin metal strip to combine any such separation means, or combinations thereof, with a conveying process based on one or more Coanda jets.

BRIEF DESCRIPTION OF THE DRAWINGS

Referring to FIG. 1, a fluid jet 15 (which may be any suitable pressurized fluid such as air, water, oil, etc.,) is injected into and caused to flow from a slit 14, flows around a curve 17 through a space defined between a wall 18 parallel to the jetting direction 16 and an opposing wall having convex curvature 17. The flow of the fluid jet tends to be attracted to the convex surface 17 more than the flat surface 18 and thus tends to flow along the convex wall 17 rather than in the jetting direction 15, thus forming a jet 9 adjacent a surface of the strip upon leaving the convex surface 17.

DESCRIPTION OF THE PREFERRED EMBODIMENTS

Figure 1:
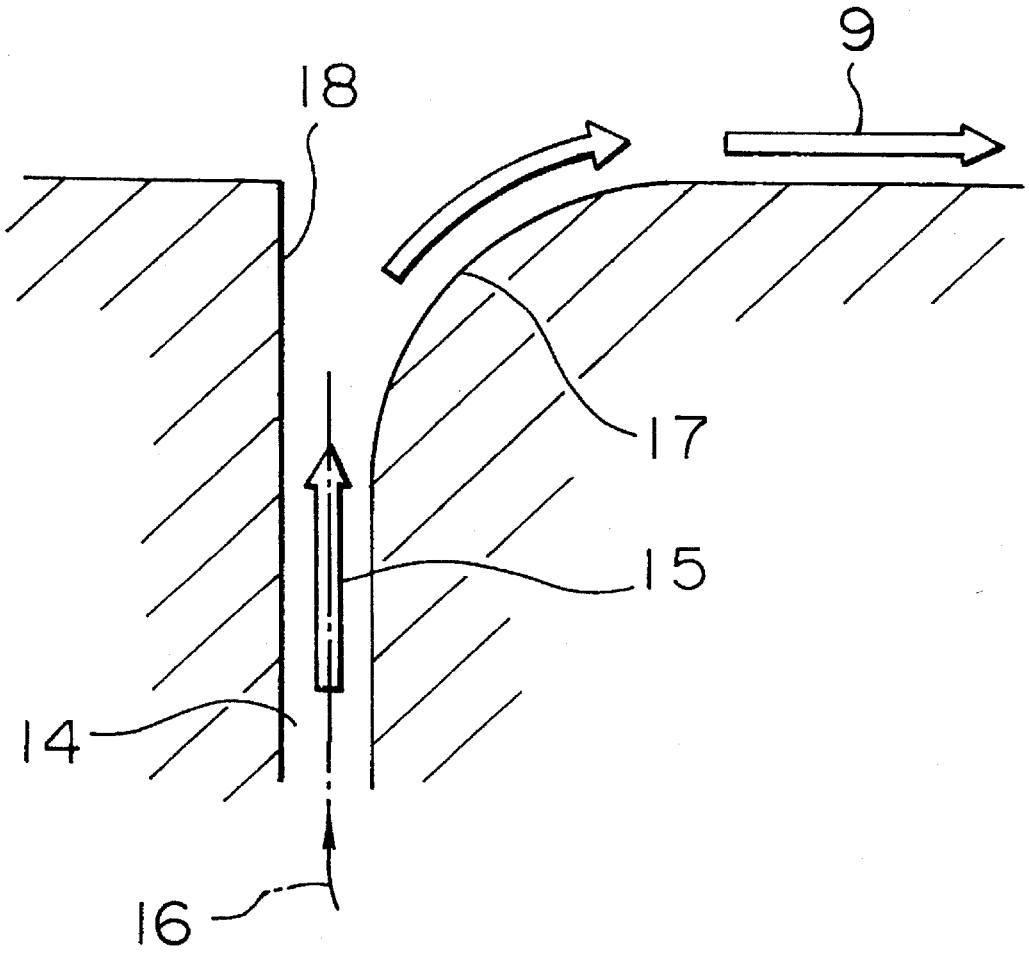
FIG. 1 PRIOR ART
FIG. 1 is an illustration of a known apparatus for generating a Coanda jet based upon the Coanda effect.

FIGS. 2A to 2D show different embodiments of thin metal strip conveying apparatus of the present invention incorporating a Coanda jet generating device, for conveying a quenched thin metal strip to nip rolls, after separation of the thin metal strip from the quenching roll by various methods.

Referring to these Figures, a molten metal is poured through a pouring nozzle 1 onto the surface of a quenching roll 2 which is rotating at high speed. Upon contact with the surface of the roll 2, the molten metal is quenched to form a thin strip 7. The thin metal strip is separated from the surface of the quenching roll by separating means which is a mechanical knife 3 in the embodiment shown in FIG. 2A, an air knife 4 in the embodiment shown in FIG. 2B, a magnetic roll 5 in the embodiment shown in FIG. 2C and a vacuum suction conveyor 6 in the embodiment shown in FIG. 2D. The thin metal strip 7 thus separated from the quenching roll 2 is conveyed to the nip of pinch rolls 10 so as to be nipped by the latter, along a fly path which is stabilized by a Coanda jet 9 generated by a Coanda jet generating device 8.

Figure 2A:
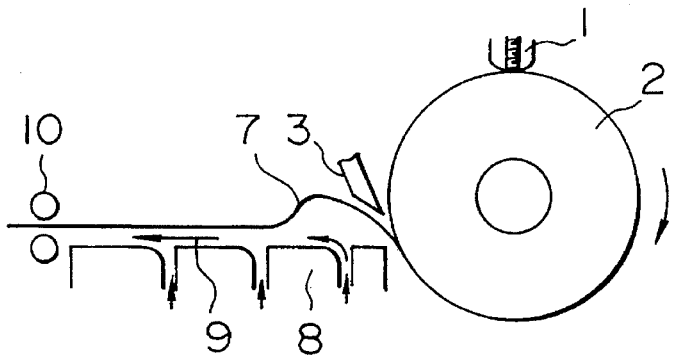
FIG. 2A is an illustration of a thin metal strip conveying apparatus of the invention with a Coanda jet generating device, for conveying a quenched thin metal strip to pinch rolls after separation from a quenching roll by a mechanical knife.
Figure 2B:
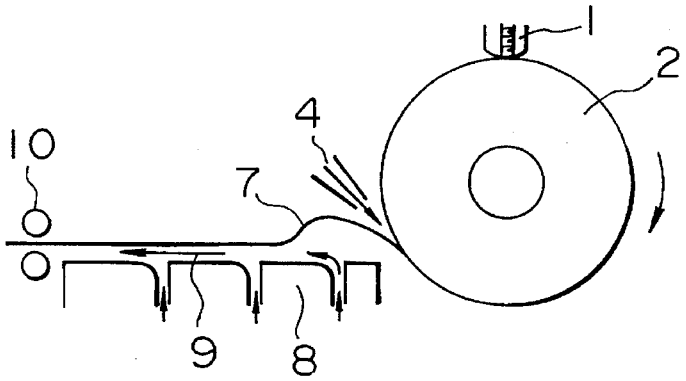
FIG. 2B is an illustration like FIG. 2A using an air knife.
Figure 2C:
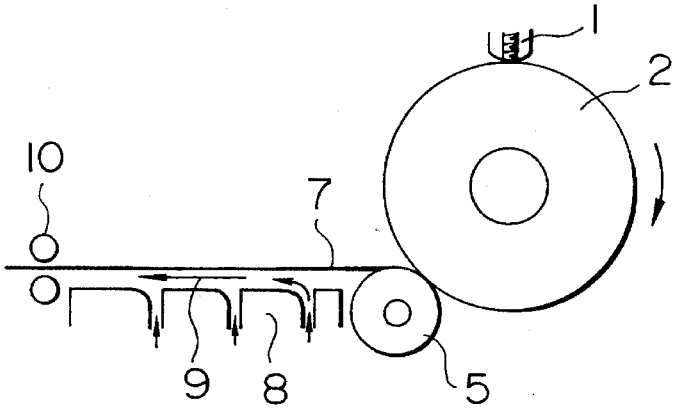
FIG. 2C is an illustration like FIGS. 2A and 2B, using a magnetic roll.
Figure 2D:
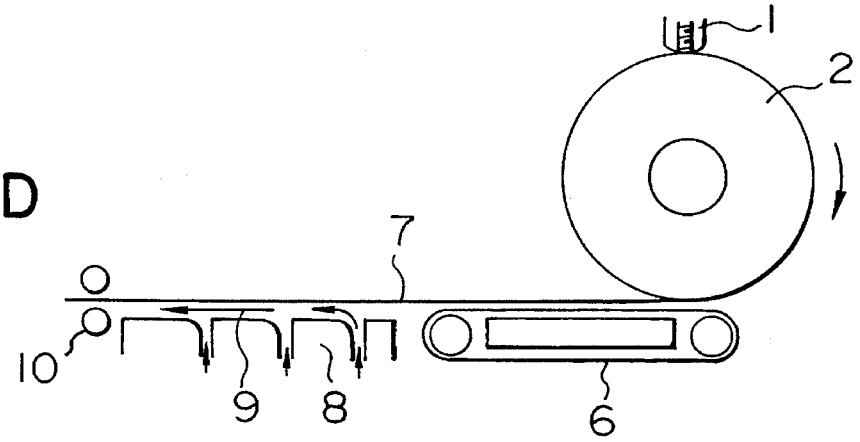
FIG. 2D is an illustration like FIGS. 2A, 2B and 2C, using a vacuum suction conveyor.

In the embodiment shown in FIG. 2C which employs a magnetic roll 5 for separating the thin metal strip 7 from the quenching roll 2, it is preferred that the magnetic roll 5 has a magnetic portion and a non-magnetic portion for ease of release of the thin metal strip 7 therefrom.

The embodiment shown in FIG. 2C may be modified using a vacuum roll in place of the magnetic roll 5 for separating the thin metal strip 7 from the quenching roll 2, so that conveying can be done safely even when the thin metal strip 7 is non-magnetic. Such a vacuum roll is preferably a small-sized roll having an air-permeable surface. This vacuum roll is rotated in contact with the quenching roll while air inside the vacuum roll is induced through a conduit formed in the shaft of this roll, whereby the thin metal strip 7 is sucked and separated from the quenching roll 2.

In each case the thin metal strip 7 conveyed by the Coanda jet 9 is pinched by the pinch rolls 10 and is then coiled by a coiling reel. The conveying apparatus of the present invention, however, may be designed and constructed in various ways such that the thin metal strip separated from the quenching roll 2 is directly coiled by the coiling reel without being pinched by the pinch rolls 10.

Figure 3:
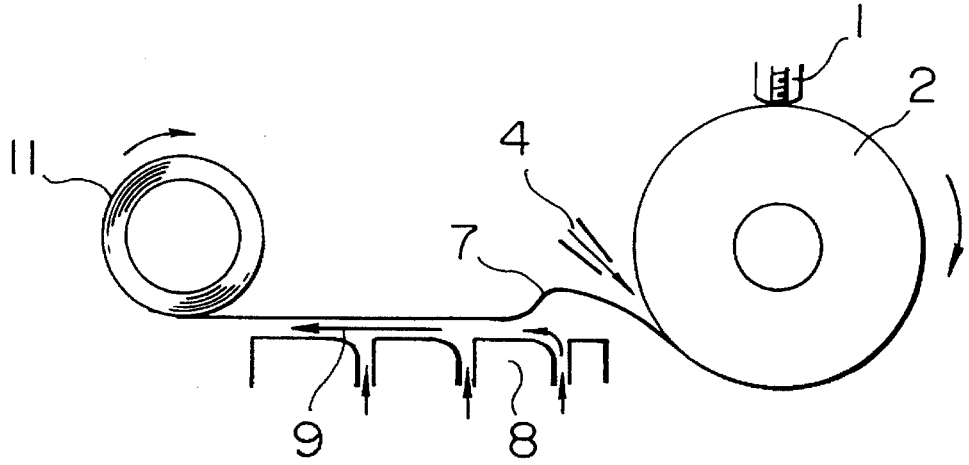
FIG. 3 is an illustration of apparatus of the invention for conveying a quenched thin metal strip to a coiling device after separation from a quenching roll by an air knife.

FIG. 3 illustrates an embodiment in which a thin metal strip 7 is separated from the quenching roll 2 by an air knife 4 and is directly conveyed to a coiling system. As will be seen from this Figure, the separated thin metal strip 7 is directly introduced to the coiling system 11 by means of a Coanda jet 9.

Figure 4:
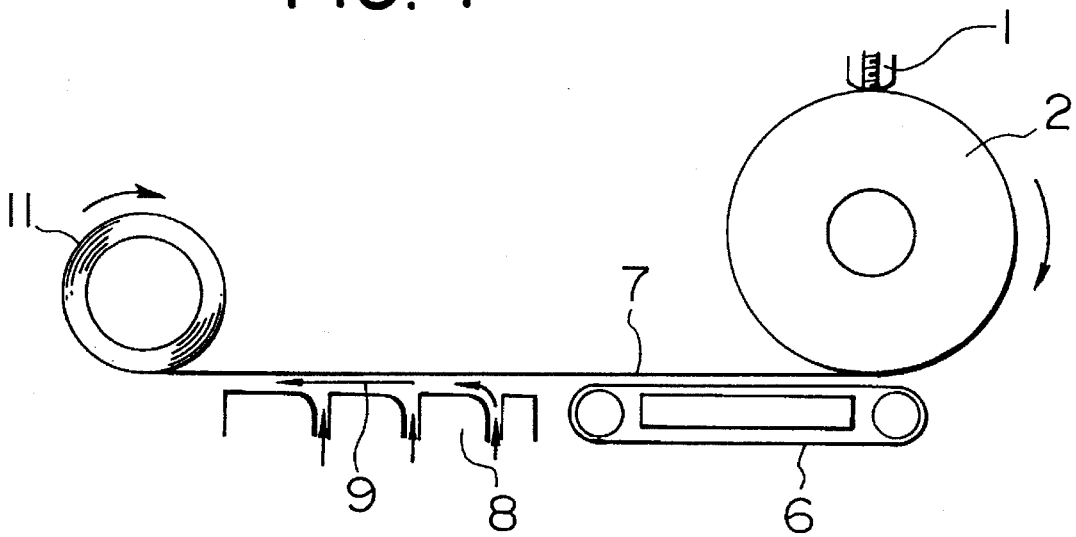
FIG. 4 is an illustration of apparatus of the invention connected in series to the quenching apparatus, for conveying a quenched thin metal strip directly to a coiling device after separation of the strip from the quenching roll by a vacuum suction type conveyor.

FIG. 4 illustrates an embodiment in which a thin metal strip 7 is separated from the quenching roll 2 by a vacuum suction conveyor 6 and is directly conveyed to a coiling system 12. As will be seen from this Figure, a stable fly path of the thin metal strip 7 is obtained by cooperation between a Coanda jet generating device 8 and the vacuum suction conveyor 6 which is arranged in series to the Coanda jet generating device 8.

Figure 5:
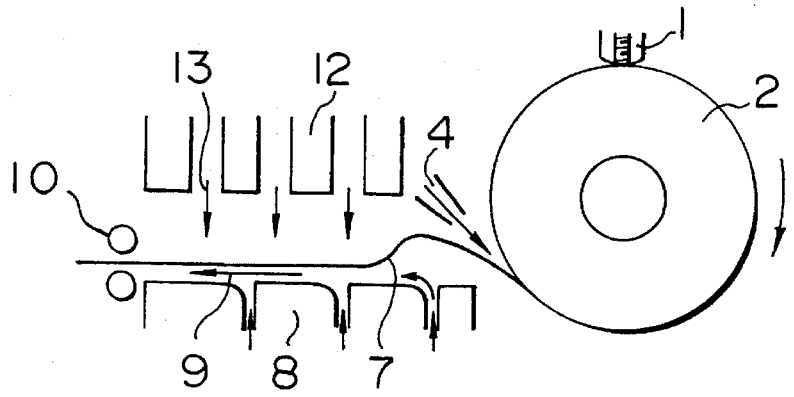
FIG. 5 is an illustration of apparatus of the invention for conveying a quenched thin metal strip from a quenching roll to nip rolls, wherein an additional fluid jet is applied to the upper side of the thin metal strip after the thin metal strip is separated by an air knife from the quenching roll until the thin metal strip reaches the nip rolls.

FIG. 5 illustrates an embodiment in which a thin metal strip is separated from the quenching roll and is conveyed to pinch rolls. During conveyance, an additional fluid jet is applied to the upper side of the thin metal strip. Referring to this Figure, if the thin metal strip 7 tends to deviate from the Coanda jet 9, the additional jet 13 applied by device 12 acts on the upper side of the thin metal strip 7 so as to forcibly urge the strip to follow the path of Coanda jet 9. With the assistance of the additional fluid jet, it is possible to further stabilize the fly path of the thin metal strip 7 after separation.

Figure 6:
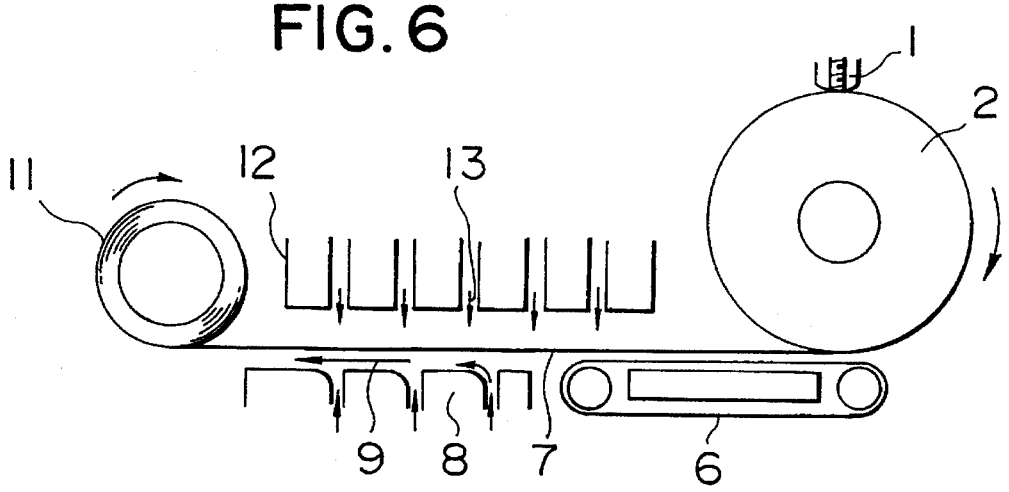
FIG. 6 is an illustration of apparatus of the invention for conveying a quenched thin metal strip from a quenching roll directly to a coiling device, wherein the thin metal strip is separated from the quenching roll by a vacuum suction device and conveyed by connection of the Coanda jet generating device and the vacuum suction conveyor, while a fluid jet is applied to the upper side of the thin metal strip.

FIG. 6 shows an embodiment in which a thin metal strip is separated from the quenching roll by means of a vacuum suction conveyor and is directly conveyed to a coiling system. In this embodiment, the vacuum suction conveyor 6 and the Coanda generating device 8 are arranged in series and, in addition, an additional fluid jet is applied to the upper surface of the thin metal strip, whereby the fly path of the thin metal strip is further stabilized.

Figure 7:
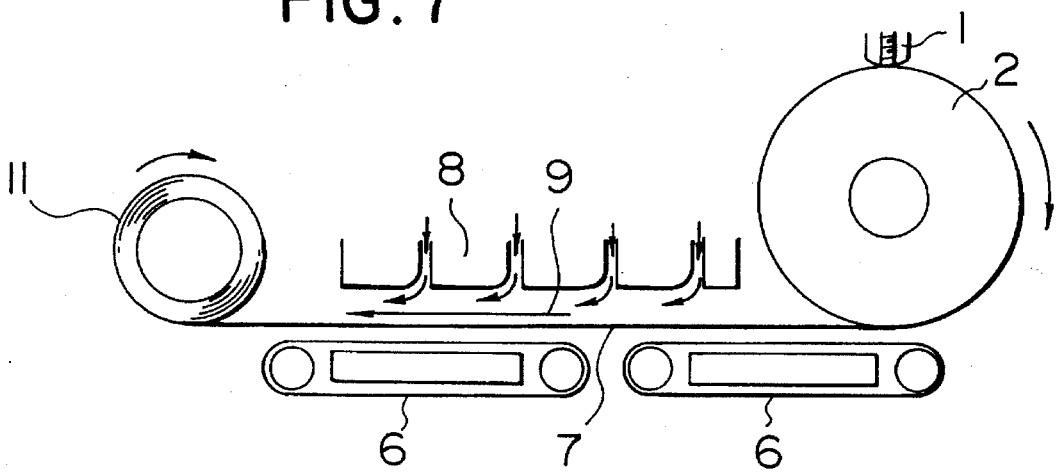
FIG. 7 is an illustration of apparatus of the present invention for conveying a thin metal strip from a quenching roll directly to a coiling device, wherein the thin metal strip, separated from the quenching roll by a vacuum suction conveyor, is conveyed by cooperation of a Coanda jet generating device and another vacuum suction conveyor connected in series to the suction vacuum conveyor.

FIG. 7 shows an arrangement in which a thin metal strip is separated from the quenching roll by means of a vacuum suction conveyor and is then directly conveyed to a coiling system. As will be seen from the Figure, this embodiment employs a pair of vacuum suction conveyors 6, 6 arranged in series, and a multiple Coanda jet generating device 8 provided on the upper side of the thin metal strip 7. In this embodiment, the jet generated by the Coanda jet generating device 8 acts on the upper side of the thin metal strip 7 so that the thin metal strip can fly stably along a constant path.

Thus, in the embodiments described hereinbefore, the fly path of the thin metal strip is stabilized in one of various ways by the Coanda effect. This principle is fundamentally different from an insertion device of the type disclosed in U.S. Pat. No. 4,450,997, which relies upon a suction jet for introducing a thin strip into a coiling device.

The following Examples are illustrative of selected forms of the invention. They are not intended to define or to limit the scope of the invention which is defined in the appended claims.

EXAMPLE 1

A molten alloy of 1600° C. was prepared containing Fe: 74 wt %, Cr: 18 wt % and Ni: 8 wt %. The molten alloy was poured from a slit-type pouring nozzle onto a roll of 800 mm diameter rotating at a high speed (peripheral velocity: 30 m/sec), thus forming a thin metal strip 50 μm thick and 100 mm wide. In several runs the thin metal strip thus formed was conveyed to the nip between nip rolls by using each of the embodiments shown in FIGS. 2A, 2B, 2C and 2D, and time measurements were made. Each time was measured from the moment at which the molten alloy was poured onto the roll until the moment at which the thin metal strip was nipped. This was done in each of the above-mentioned embodiments.

In each case, three Coanda jet generating device units were arranged along the fly path of the thin metal strip, such that the Coanda jet flowed toward the pinch rolls.

Each Coanda jet generating device had a static pressure chamber from which air was jetted through a jet slit having a width of 1.0 mm and a length 1.5 times the width of the thin metal strip, so that a Coanda jet was formed along a curved surface of 50 mm radius provided at one side of the slit. The spacing of the slits was set to 300 mm. The velocity of the jet of air was set to 60 m/sec when measured in the horizontal direction, i.e., in the direction of running of the thin metal strip.

At the same time, the pressure of the jet 10 shown in FIG. 5 was set to be 2.0 kgf per 100 $cm^2$.

As a comparative example, a similar test was conducted by using a conventional conveying method in which the thin metal strip was separated by an air knife and conveyed with no Coanda jet into the nip of pinch rolls through a stationary hood. In order to provide a guide for the thin metal strip, a suction blower was placed between the pinch rolls and the coiling system. The length of time between the moment at which the pouring was commenced and the moment at which the thin metal strip was pinched by the pinch rolls was measured.

Figure 8:
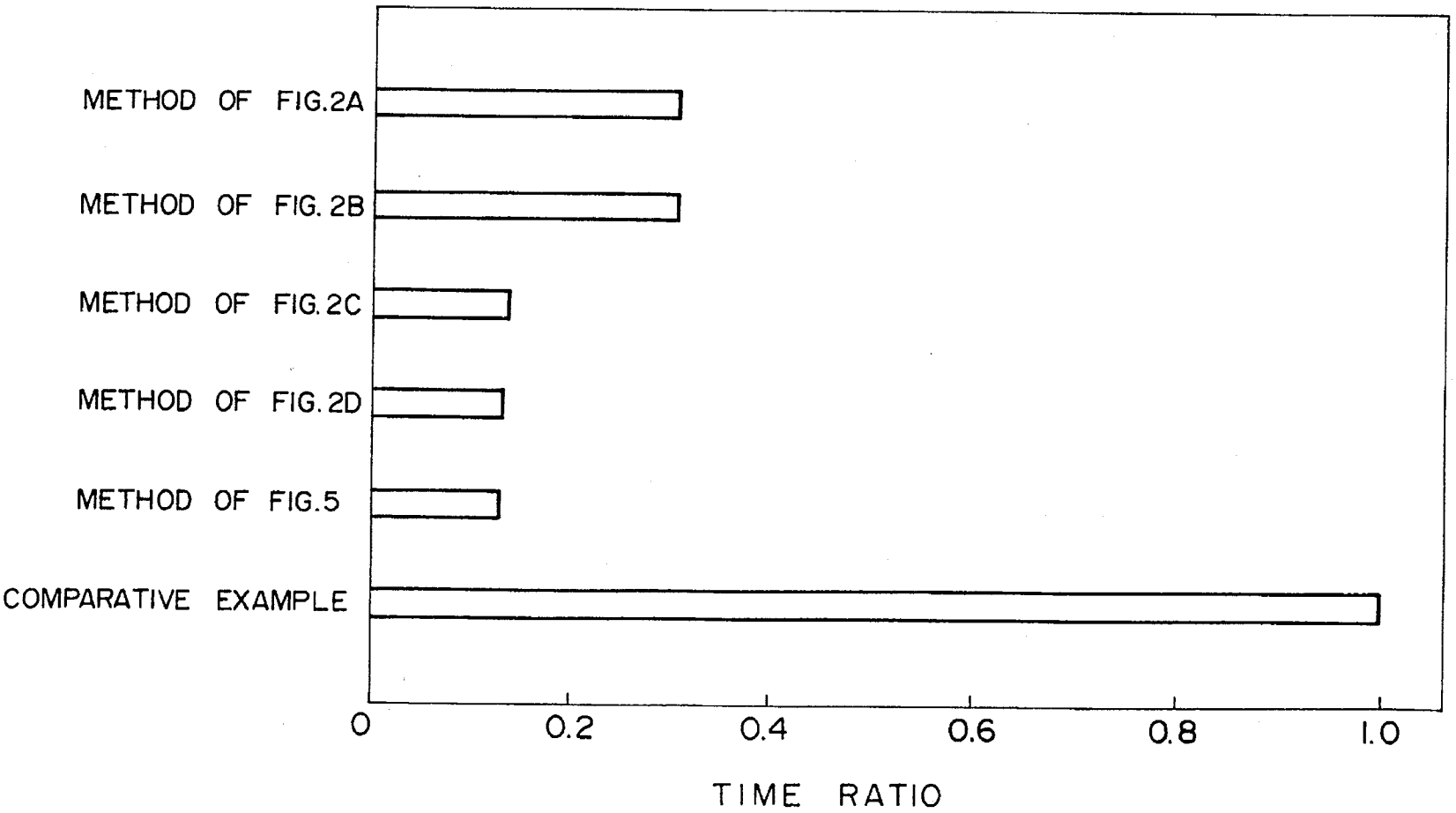
FIG. 8 is a graph showing typical lengths of time required until thin metal strips are pinched by pinch rolls after pouring of metal melts, in different embodiments of the conveying apparatus of the present invention, in comparison with a comparative example.

The measured lengths of time are shown in a graph in FIG. 8, in terms of ratio to the time 1.0 measured in the comparative example.

As will be clear from FIG. 8, the examples carrying out the present invention remarkably shorten the time elapsing between pour time and nipping time. The method of FIGS. 2A and 2B required only about one-third of the time required in the Comparative Example, and FIGS. 2C, 2D and 5 even less than one-fifth. In particular, an excellent effect was obtained when an additional jet was applied to the upper side of the thin metal strip in accordance with the method shown in FIG. 5, and when a magnetic roll was used for the purpose of separation of the thin strip in accordance with the embodiment shown in FIG. 2C, as well as when a vacuum suction conveyor shown in FIG. 2D was used for the purpose of separating the thin metal strip.

It was also confirmed that an equivalent effect is obtainable when a vacuum roll is used in place of the magnetic roll as means for separating the thin metal strip from the quenching roll.

EXAMPLE 2

A thin metal strip 50 μm thick and 100 mm wide was prepared from the same alloy composition and under the same condition as Example 1. The thin metal strip was conveyed along a stable fly path provided by various types of conveying apparatus incorporating a Coanda jet generating device, using each of the embodiments of the invention shown in FIGS. 3, 4, 6 and 7, and the elapsed time was measured between the moment at which the molten alloy was poured and the moment at which coiling was commenced.

The arrangement and construction of the Coanda jet generating devices were the same as those described before. The suction force produced by the vacuum suction conveyor and the pressure of the jet acting on the upper side of the thin metal strip were both 2.0 kgf per 100 $cm^2$.

As a comparative example, a test also was conducted in accordance with the known method described before, by pinching the thin metal strip before the latter is coiled by the coiling system.

Figure 9:
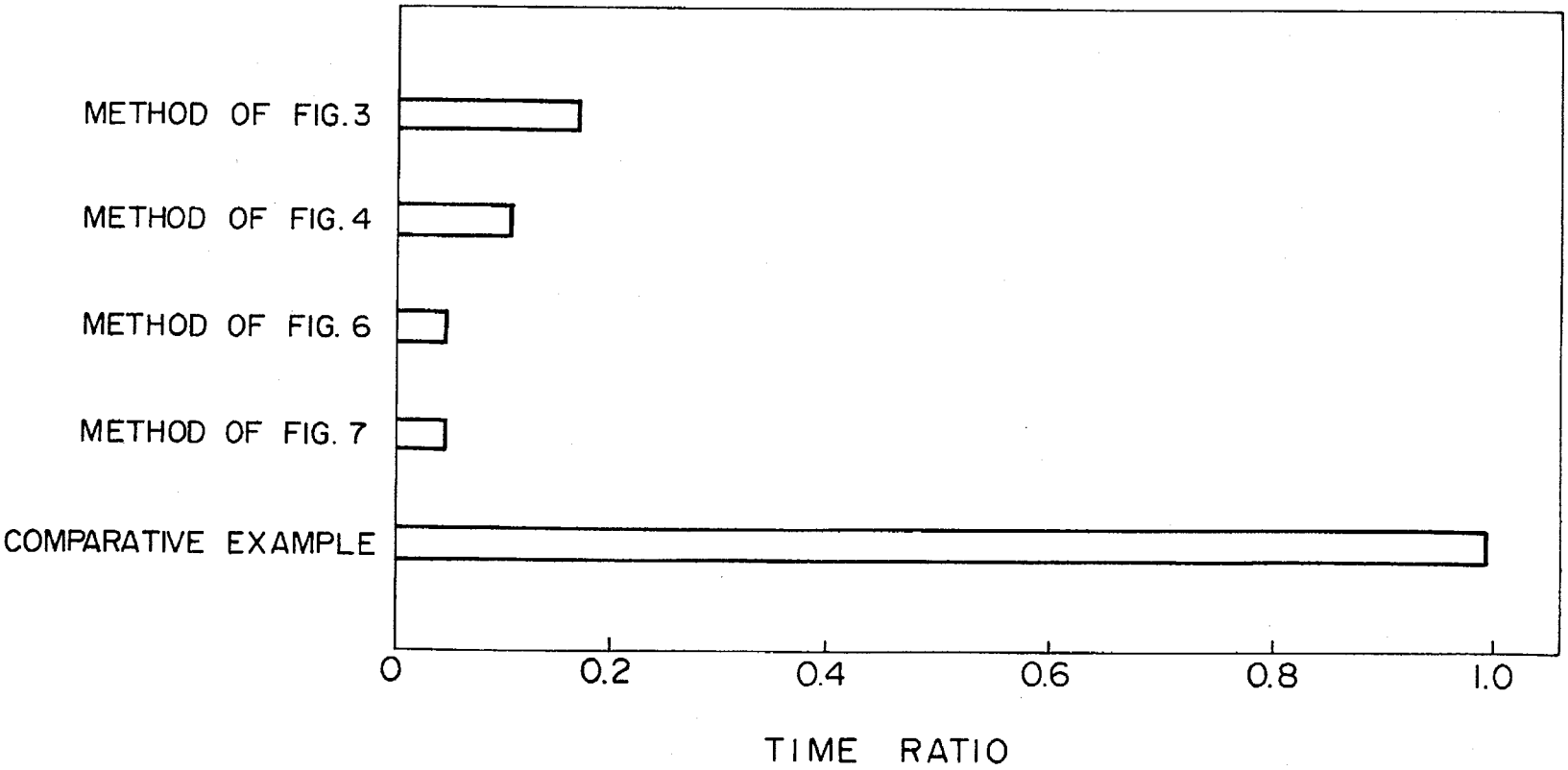
FIG. 9 is another graph showing typical lengths of time required until coiling of thin metal strips is commenced after pouring of metal melts, in different embodiments of the conveying apparatus of the present invention, in comparison with a comparative example.

FIG. 9 shows the results of measurement of the time length for each of the cases following the embodiments of FIGS. 3, 4, 6 and 7, as well for the comparison example, in terms of the ratio to the reference time length 1.0 measured for the comparison example. As will be understood from FIG. 9, the method in accordance with the embodiment shown in FIG. 3 remarkably shortens the time from pouring to coiling of the thin metal strip, as compared with the known method. A further improvement was achieved when a Coanda jet generating device and a vacuum suction conveyor were connected in series as in the embodiment shown in FIG. 4. Particularly excellent results were obtained when an additional fluid jet was applied in accordance with the embodiment shown in FIG. 6, and when a pair of vacuum suction conveyors were connects in series while the Coanda jet was applied to the upper side of the thin metal strip as in the embodiment shown in FIG. 7.

In the two embodiments mentioned above, the velocity of air of the Coanda jet was set to be 60 m/sec as measured in the horizontal direction (direction of running of the thin metal strip). However, we have found that, in order to attain good results, the velocity of the Coanda jet air preferably falls within the range between about 15 and 70 m/sec, more preferably between about 20 and 90 m/sec.

Therefore, factors such as the radius of curvature of the curved surface in the Coanda jet generating device and so forth are preferably determined based on the flow velocity of the Coanda jet air to be obtained.

More practically, in order to convey a thin metal strip having a width of "a" mm ($2 \leqq a \leqq 800$), the slit width w, slit spacing d and the radius r of curvature are preferably determined to meet the condition of $w>a$, $d \geqq 900$ mm and $30 \text{ mm} \leqq r \leqq 200$ mm.

As will be understood from the foregoing description, according to this invention, a thin metal strip formed from a molten metal by quenching on a quenching roll and separated from the quenching roll, is caused to fly along a path which is stabilized by the Coanda effect. The flying thin metal strip can be delivered into the nip of subsequent pinch rolls in a much shorter time than the conventional technique allows. This provides a remarkable effect in improving yield and production efficiency of thin metal strips by quenching.

What is claimed is:

1. In a method of conveying a thin metal strip formed from a molten metal by quenching on a quenching roll, and separating said strip from said quenching roll, the steps which comprise:

(a) forming a fly path from said quenching roll along which the thin metal strip is conducted, (b) stabilizing said fly path by applying to a surface of said strip a Coanda jet of a fluid, generated by conforming a portion of said jet into a curved convex path and another portion of said jet substantially perpendicular to said fly path, and (c) causing said fluid to flow along said strip.

2. A method of conveying a thin metal strip according to claim 1, wherein said roll is a single quenching roll and an additional fluid jet is applied to a surface of said thin metal strip opposite to the surface contacted by said Coanda jet.

3. A method of conveying a thin metal strip according to claim 1, wherein a surface of said thin metal strip opposite to the surface contacted by said Coanda jet is sucked by a vacuum suction type conveyor.

4. A method of conveying a thin metal strip according to any one of claims 1 or 2, wherein the separation of said thin metal strip from said quenching roll is performed by a separation knife means.

5. A method of conveying a thin metal strip according to any one of claims 1 or 2, wherein the separation of said thin metal strip from said quenching roll is effected by attracting force produced by a magnetic roll.

6. A method of conveying a thin metal strip according to any one of claims 1 or 3, wherein the separation of said thin metal strip from said quenching roll is effected by suction force applied by a vacuum roll.

7. An apparatus for conveying along a path in a downstream direction a thin metal strip formed from a molten metal by quenching on a quenching roll and conducting said strip to a nip between pinch rolls or to a coiling system, comprising:

a Coanda jet generating device located downstream of said quenching roll and having a slit with an edge having a convex curved surface and having another edge formed substantially perpendicular to both said path and the width of the thin metal strip, said Coanda jet generating device being positioned so that said fluid is caused to flow along said convex curved surface and said other edge, said jet generating device being positioned to stabilize said path.

8. An apparatus for conveying a thin metal strip according to claim 7, further comprising an additional jet generating device which applies an additional jet of fluid to the surface of said thin metal strip opposite to the surface contacted by said fluid jet.

9. An apparatus for conveying a thin metal strip according to claim 7, further comprising a vacuum suction type conveyor for applying a vacuum suction force on the surface of said thin metal strip opposite to the surface contacted by said jet.

10. An apparatus for conveying a thin metal strip according to one of claims 7 or 8, further comprising a separation knife means for separating the quenched thin metal strip from said quenching roll.

11. An apparatus for conveying a thin metal strip according to one of claims 7 or 8, further comprising a magnetic roll for separating the quenched thin metal strip from said quenching roll.

12. An apparatus for conveying a thin metal strip according to one of claims 7 or 8, further comprising a vacuum roll for separating the quenched thin metal strip from said quenching roll.

13. An apparatus for conveying a thin metal strip according to one of claims 7 or 8, further comprising a vacuum suction type conveyor for separating the quenched thin metal strip from said quenching roll.

14. The method defined in claim 12 wherein a plurality of successive convex surfaces are arranged along said fly path and adjacent said surface of said strip, each provided with a jet fluid flowing around its convex surface.

15. In a method of making metal strip from a molten metal, the steps which comprise:

(a) quenching said molten metal on a quenching roll to form said metal strip with a width extending across said path;

(b) conducting the resulting strip along a fly path from said quenching roll for engagement of said strip, (c) stabilizing said fly path by jetting a portion of a fluid along a curved convex path and another portion of said fluid substantially perpendicular to both said fly path and said width so as to form a Coanda jet, and (d) causing said fluid to flow adjacent a surface of said strip.

* * * * *

UNITED STATES PATENT AND TRADEMARK OFFICE

CERTIFICATE OF CORRECTION

PATENT NO. : 5,499,673

DATED : March 19, 1996

INVENTOR(S) : Nobuo Shiga et al

It is certified that error appears in the above-indentified patent and that said Letters Patent is hereby corrected as shown below:

In Column 1, line 43, please insert --strip.-- after "thin".

In Column 8, line 33, please insert --Coanda-- before "jet".

Signed and Sealed this

Fourth Day of June, 1996

Bruce Lehman

*Attest:*

BRUCE LEHMAN

*Attesting Officer*

*Commissioner of Patents and Trademarks*